US008734544B2

(12) United States Patent
Sugita et al.

(10) Patent No.: US 8,734,544 B2
(45) Date of Patent: May 27, 2014

(54) APPARATUS AND PROCESS FOR PRODUCING SOLID FUEL

(75) Inventors: Satoru Sugita, Takasago (JP); Yuko Sugita, legal representative, Kobe (JP); Takuo Shigehisa, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 937 days.

(21) Appl. No.: 12/811,787

(22) PCT Filed: Aug. 25, 2008

(86) PCT No.: PCT/JP2008/065082
§ 371 (c)(1),
(2), (4) Date: Jul. 6, 2010

(87) PCT Pub. No.: WO2009/087790
PCT Pub. Date: Jul. 16, 2009

(65) Prior Publication Data

US 2011/0005126 A1 Jan. 13, 2011

(30) Foreign Application Priority Data

Jan. 9, 2008 (JP) ..... 2008-001946

(51) Int. Cl.
*C10L 5/00* (2006.01)

(52) U.S. Cl.
USPC ..... 44/629; 44/620

(58) Field of Classification Search
USPC ..... 44/620, 629
See application file for complete search history.

(56) References Cited

U.S. PATENT DOCUMENTS 4,178,231 A * 12/1979 Smith et al. ..... 209/3
4,185,395 A 1/1980 Nakako et al.
4,223,449 A 9/1980 Bodle et al.

(Continued)

FOREIGN PATENT DOCUMENTS

JP 53 112902 10/1978
JP 57 501919 10/1982

(Continued)

OTHER PUBLICATIONS

Australian Office Action issued Mar. 11, 2011, in Patent Application No. 2008345969.

(Continued)

*Primary Examiner* — Cephia D Toomer
(74) *Attorney, Agent, or Firm* — Oblon, Spivak, McClelland, Maier & Neustadt, L.L.P.

(57) ABSTRACT

A solid fuel producing apparatus that even when supply of raw coal (RC) and mixed oil (MO) and supply of slurry to subsequent steps are stopped because of troubling at evaporation step or later, etc., would prevent cloggings of heat exchanger and raw coal supply means. The solid fuel producing apparatus includes a mixing tank (1) for mixing porous coal with a mixed oil having heavy oil and solvent oil contents to thereby obtain a raw slurry; an evaporator (2) for processing evaporation of water from the raw slurry by heating the same to thereby obtain a dewatered slurry; a solid-liquid separator (3) for separation of the mixed oil and upgraded porous coal from the dewatered slurry; and circulation means (4) for returning the mixed oil having been separated and recovered by the solid-liquid separator to the mixing tank. The solid fuel producing apparatus is characterized by having a mixed oil heating heat exchanger (5) for heating the mixed oil to be returned to the mixing tank by the circulation means.

7 Claims, 3 Drawing Sheets

(56) References Cited

U.S. PATENT DOCUMENTS

| | | | | |
|---|---|---|---|---|
| 4,559,060 | A | 12/1985 | Muroi et al. | |
| 4,624,807 | A | 11/1986 | Miyauchi et al. | |
| 4,671,800 | A | 6/1987 | Meyer et al. | |
| 4,671,801 | A | 6/1987 | Burgess et al. | |
| 4,908,167 | A | 3/1990 | Beckmann et al. | |
| 4,969,928 | A | 11/1990 | Wen et al. | |
| 5,162,050 | A | 11/1992 | Knudson et al. | |
| 5,503,646 | A | 4/1996 | McKenny et al. | |
| 5,554,201 | A | 9/1996 | Yagaki et al. | |
| 5,556,436 | A | 9/1996 | Yagaki et al. | |
| 6,626,966 | B2 | 9/2003 | Shimasaki et al. | |
| 2005/0097814 | A1* | 5/2005 | Sugita et al. | 44/620 |
| 2005/0204615 | A1 | 9/2005 | Sugita et al. | |
| 2007/0062103 | A1 | 3/2007 | Sugita et al. | |
| 2010/0077658 | A1 | 4/2010 | Sugita et al. | |

FOREIGN PATENT DOCUMENTS

| | | |
|---|---|---|
| JP | 58 187490 | 11/1983 |
| JP | 7 233383 | 9/1995 |
| JP | 7 233384 | 9/1995 |
| JP | 2005 206695 | 8/2005 |
| JP | 2007 138103 | 6/2007 |

OTHER PUBLICATIONS

U.S. Appl. No. 13/124,133, filed Apr. 14, 2011, Sugita, et al.
U.S. Appl. No. 13/290,466, filed Nov. 7, 2011, Sugita, et al.

* cited by examiner

APPARATUS AND PROCESS FOR PRODUCING SOLID FUEL

TECHNICAL FIELD

The present invention relates to an apparatus and a process for producing a solid fuel by using porous coal as the raw material.

BACKGROUND ART

The outline of a known method for producing a solid fuel by using porous coal as the raw material is explained. Porous coal (raw coal) is pulverized at a pulverization step and thereafter mixed with mixed oil containing a heavy oil content and a solvent oil content at a mixing step, and thereby a raw slurry is obtained. Successively, the raw slurry is preheated and thereafter heated at an evaporation step, thereby the porous coal is dewatered and the mixed oil is impregnated into the pores of the porous coal, and thereby a dewatered slurry is obtained. Thereafter the upgraded porous coal and the mixed oil are separated from each other in the dewatered slurry at a solid-liquid separation step and thereafter the upgraded porous coal is dried at a final drying step. The dried upgraded porous coal is cooled and briquetted if desired and thus a solid fuel is obtained. Meanwhile, the mixed oil recovered at the solid-liquid separation step and the final drying step is recirculated to the mixing step for obtaining a raw slurry and reused as recycle oil.

An example of the schematic configuration diagram of an apparatus adopting such a method is shown in FIG. 4 (Patent Document 1). The apparatus shown in FIG. 4 comprises a mixing tank 101 for mixing porous coal with mixed oil containing a heavy oil content and a solvent oil content and thereby producing a raw slurry, an evaporator 102 for processing evaporation of water from the raw slurry, and a solid-liquid separator 103 for separating solid and liquid from each other in the dewatered slurry having been processed for the evaporation of water. Here, the mixing tank 101 includes slurry circulating flow channels 111 and 113 for introducing the raw slurry from the lower part of the mixing tank 101 to the upper part thereof with a slurry pump 112. The evaporator 102 includes slurry circulating flow channels 121, 123, and 124 for introducing the slurry from the lower part of the evaporator 102 to the upper part thereof with a slurry pump 122. A raw slurry supplying flow channel 114 is installed between the mixing tank 101 and the evaporator 102. The raw slurry supplying flow channel 114 branches from the slurry circulating flow channels 111 and 113.

A raw slurry is produced by mixing porous coal with mixed oil containing a heavy oil content and a solvent oil content in the mixing tank 101. The raw slurry: is introduced from the lower part of the mixing tank 101 to the upper part thereof through the slurry circulating flow channels 111 and 113 with the slurry pump 112; and is circulated. With being circulated, the raw slurry: enters the slurry circulating flow channels 123 and 124 of the evaporator 102 through the raw slurry supplying flow channel 114 branching from the slurry circulating flow channels 111 and 113; and enters the evaporator 102 therethrough. On this occasion, the raw slurry is heated with heat exchangers 110*a* and 115*a* (a preheating step), is further heated with a heat exchanger 120, and enters the evaporator 102 (an evaporation step). At the evaporator 102, water in the raw slurry is evaporated.

The dewatered slurry obtained by the water evaporation enters the solid-liquid separator 103 for separating solid and liquid from each other through a dewatered slurry supplying flow channel 125 branching from the slurry circulating flow channels 121, 123, and 124 and thereby a solid content (upgraded porous coal) and a liquid content (mixed oil) are obtained. An oil content remaining in the solid content is recovered at a final drying section (not shown in the figure) and the solid content comes to be the state of being used as a powdered solid fuel. Meanwhile, the recovered mixed oil is returned to the mixing tank 101 by a circulation means 104.

With the apparatus shown in FIG. 4 however, when trouble occurs at the evaporation step or subsequent steps, problems arise if the supply of raw coal (RC) and mixed oil (MO) at the mixing step and the supply of slurry to the subsequent steps are stopped in order to prevent slurry from overflowing at each step. More specifically, on this occasion, slurry pumps and stirrers are always operated in order to avoid the clogging of pipes caused by the sedimentation of coal in the slurry at the mixing step and the evaporation step but the clogging of pipes occurs in a heat exchanger as it will be shown below.

Many pipes through which slurry passes are installed in a heat exchanger as shown in FIG. 5(A) and the slurry in the individual pipes is heated by a heating medium such as steam. In the apparatus shown in FIG. 4, when the supply of raw coal (RC) and mixed oil (MO) and the supply of slurry to subsequent steps are stopped and the slurry pumps 112 and 122 are always operated, the slurry stops to flow and coal in the slurry settles out in the heat exchangers 110*a* and 115*a* and the coal (RC) at the lower part and the mixed oil (MO) at the upper part separate from each other in each of the heat exchangers as shown in FIG. 5(B). The coal settled at the lower part deposits firmly and hence it is necessary to feed gas or slurry of a high pressure and pressurize the clogged pipes in order to feed the slurry again. If the pipes in a heat exchanger are pressurized however, a pipe of a relatively low degree of clogging is unclogged firstly, a pipe of a relatively high degree of clogging cannot be pressurized effectively, and the pipes are not completely unclogged.

In view of the above situation, Patent Document 2 reports a technology of installing heat exchangers 110*b* and 115*b* in slurry circulating flow channels 111 and 113 of a mixing tank 101 as shown in FIG. 6 in place of the heat exchangers 110*a* and 115*a* in FIG. 4. In such a configuration, the flow of slurry is maintained in the heat exchangers 110*b* and 115*b* by a slurry pump 112 and hence the clogging of pipes caused by the sedimentation of coal does not occur. The reference symbols in FIG. 6 represent the same instruments and members as those represented by the same reference symbols used in FIG. 4 respectively and hence the explanations thereof are omitted.

Patent Document 1: JP-A No. 233383/1995 (H7)

Patent Document 2: JP-A No. 206695/2005

DISCLOSURE OF THE INVENTION

Problem to be Solved by the Invention

When the supply of raw coal (RC) and mixed oil (MO) and the supply of slurry to the subsequent steps are stopped and the slurry pumps 112 and 122 are always operated in an apparatus shown in FIG. 6 however, a new problem arises. More specifically, on this occasion, the steam supply to the heat exchangers 110*b* and 115*b* is also stopped but it takes time for the steam to be completely evacuated from the heat exchangers and hence, even when the supply of the steam is stopped, the slurry is kept heated by the circulation for a while and hence the temperature comes to exceed 100° C. As a result, steam is generated from coal in the slurry in a mixing tank 101, the steam condensates in a supplying means 116 such as a rotary valve to supply the raw coal (RC), the raw coal sticks to the condensed water, and thereby clogging occurs.

Further, in the apparatuses shown in FIGS. 4 and 6, the substance heated at the heat exchangers is slurry and the grain size of the pulverized coal contained in the slurry is up to about several millimeters and hence wear resistant SUS304 is used as the material for the pipes in the heat exchangers. That causes the problem of the production cost.

An object of the present invention is to provide an apparatus and a process for producing a solid fuel that make it possible to prevent heat exchangers and a raw coal supplying means from clogging even when the supply of raw coal (RC) and mixed oil (MO) and the supply of slurry to the subsequent steps are stopped because of troubles and the like at the evaporation step and the subsequent steps.

Means for Solving the Problem

The present invention relates to an apparatus for producing a solid fuel comprising:

a mixing tank for obtaining a raw slurry by mixing porous coal with mixed oil containing a heavy oil content and a solvent oil content;

an evaporator for obtaining a dewatered slurry by heating the raw slurry and thereby processing the evaporation of water;

a solid-liquid separator for separating the upgraded porous coal and the mixed oil from each other in the dewatered slurry; and a circulation means for returning the mixed oil having been separated and recovered with the solid-liquid separator to the mixing tank, wherein the apparatus has a mixed oil heating heat exchanger for heating the mixed oil returned to the mixing tank by the circulation means.

The present invention further relates to a process for producing a solid fuel comprising:

a mixing step for obtaining a raw slurry by mixing porous coal with mixed oil containing a heavy oil content and a solvent oil content;

an evaporation step for obtaining a dewatered slurry by heating the raw slurry and thereby processing the evaporation of water;

a solid-liquid separation step for separating the upgraded porous coal and the mixed oil from each other in the dewatered slurry; and a circulation step for returning the mixed oil having been separated and recovered at the solid-liquid separation step to the mixing tank, wherein the process includes a mixed oil heating step for heating the mixed oil returned to the mixing tank at the circulation step.

Effect of the Invention

The present invention makes it possible to prevent heat exchangers and a raw coal supplying means from clogging even when the supply of raw coal (RC) and mixed oil (MO) and the supply of slurry to the subsequent steps are stopped because of troubles or the like at the evaporation step and the subsequent steps.

EXPLANATIONS OF REFERENCE SYMBOLS

1: Mixing tank, 2: Evaporator, 3: Solid-liquid separator, 4: Circulation means, 5: Mixed oil heating heat exchanger, 6: Raw coal supplying means, 11, 13: Slurry circulating flow channel, 12, 22, 27, 32: Slurry pump, 14: Raw slurry supplying flow channel, 20: Heat exchanger, 21, 23, 24: Upstream side slurry circulating flow channel, 26, 28, 29: Downstream side slurry circulating flow channel, 2A: First evaporator, 2B: Second evaporator, 31, 33, 34: Slurry circulating flow channel, 45: Mixed oil circulating flow channel, 50: Compressor, 51, 52, 53: Heating medium flow channel, 61: Dewaterer, 62: Stirrer, 63: Slurry pump, 64: Heat exchanger, 65: Pipe, 101: Mixing tank, 102: Evaporator, 103: Solid-liquid separator, 104: Circulation means, 116: Raw coal supplying means, 111, 113: Slurry circulating flow channel, 112, 122: Slurry pump, 114: Raw slurry supplying flow channel, 120: Heat exchanger, 121, 123, 124: Slurry circulating flow channel.

BEST MODE FOR CARRYING OUT THE INVENTION

First Embodiment

Figure 1:
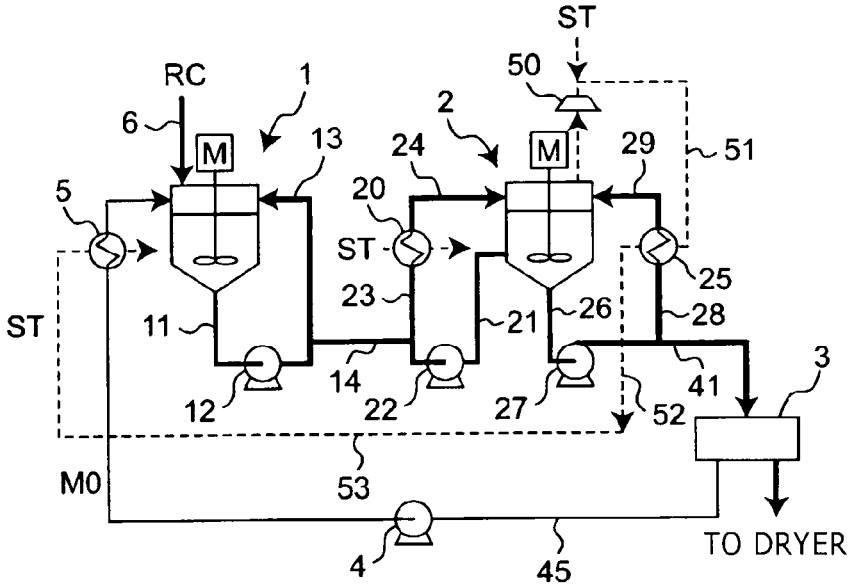
FIG. 1 is a general configuration diagram showing an embodiment of an apparatus for producing a solid fuel according to the present invention.

An apparatus for producing a solid fuel according to a first embodiment of the present invention is shown in FIG. 1.

An apparatus according to the present embodiment comprises:

a mixing tank 1 for obtaining a raw slurry by mixing porous coal with mixed oil containing a heavy oil content and a solvent oil content;

an evaporator 2 for obtaining a dewatered slurry by heating the raw slurry and thereby processing the evaporation of water;

a solid-liquid separator 3 for separating the upgraded porous coal and the mixed oil from each other in the dewatered slurry; and a circulation means 4 for returning the mixed oil having been separated and recovered with the solid-liquid separator to the mixing tank, and is characterized in that the apparatus further has a mixed oil heating heat exchanger 5 for heating the mixed oil returned to the mixing tank by the circulation means. Here, the mixing tank 1 has slurry circulating flow channels 11 and 13 for introducing a raw slurry from the lower part of the mixing tank 1 to the upper part thereof with a slurry pump 12. The evaporator 2 has upstream side slurry circulating flow channels 21, 23, and 24 for introducing slurry from the lower part of the evaporator 2 to the upper part thereof with a slurry pump 22 on the upstream side. The evaporator 2 further has downstream side slurry circulating flow channels 26, 28, and 29 for introducing slurry from the lower part of the evaporator 2 to the upper part thereof with a slurry pump 27 on the downstream side. A raw slurry supplying flow channel 14 is installed between the mixing tank 1 and the evaporator 2. The raw slurry supplying flow channel 14 branches from the slurry circulating flow channels 11 and 13. A dewatered slurry supplying flow channel 41 is installed between the evaporator 2 and the solid-liquid separator 3. The dewatered slurry supplying flow channel 41 branches from the slurry circulating flow channels 26, 28 and 29. A mixed oil circulating flow channel 45 for returning the mixed oil separated with the solid-liquid separator 3 to the mixing tank 1 is installed between the solid-liquid separator 3 and the mixing tank 1.

The mixed oil heating heat exchanger 5, together with the circulation means 4, is installed in the mixed oil circulating flow channel 45. The heat source (the heating medium) of the heat exchanger is not particularly limited but it is preferable to use steam generated at the evaporator 2 for example. Since the raw slurry can be preheated by installing the heat exchanger 5 in the mixed oil circulating flow channel 45 and heating the mixed oil, the installation of a slurry heating heat exchanger in the slurry circulating flow channels 11 and 13 can be omitted. Consequently, even if a raw slurry is circulated in the slurry circulating flow channels 11 and 13 when the supply of raw coal (RC) and mixed oil (MO) and the supply of slurry to the subsequent steps are stopped, excessive temperature rise of the raw slurry does not occur. As a result, the generation of steam in the mixing tank is inhibited and resultantly the clogging of a raw coal supplying means 6 can be prevented. Further, since the installation of a slurry heating heat exchanger in the slurry circulating flow channels 11 and 13 can be omitted, the clogging of the slurry heating heat exchanger itself is not concerned. Furthermore, since the substance heated with the heat exchanger 5 is not the slurry but the mixed oil separated as a liquid content (recycle oil) with the solid-liquid separator and generally pulverized coal about 10 μm less in grain size is contained by about 10 weight, the settling velocity of the pulverized coal is markedly lower than that of coal in slurry. Consequently, the clogging of the heat exchanger 5 itself can be prevented effectively even when the supply (circulation) of the mixed oil (MO) is stopped. In addition, since the substance heated with the heat exchanger 5 is the mixed oil containing pulverized coal of small grain sizes as stated above, not only an expensive material such as SUS304 but also a less-expensive material such as carbon steel can be used as the material for the heat exchanger.

As the heat exchanger 5, not only a relatively large heat exchanger such as a multi-tube type heat exchanger but also a relatively small heat exchanger such as a plate type or spiral type heat exchanger can be used. The reason is that the coal included in the mixed oil is pulverized coal and the settling velocity is markedly low.

The heating temperature of the mixed oil obtained with the heat exchanger 5 is not particularly limited as long as the temperature of the raw slurry in the mixing tank 1 is a temperature not exceeding 100° C., and usually the temperature of the raw slurry in the mixing tank 1 is set at 70° C. to 80° C.

In the mixing tank 1, a raw slurry is produced by mixing porous coal with mixed oil containing a heavy oil content and a solvent oil content (the mixing step). The mixed oil is heated with the heat exchanger 5 and hence the raw slurry is already preheated appropriately in the mixing tank. The raw slurry is introduced from the lower part of the mixing tank 1 to the upper part of the mixing tank 1 through the slurry circulating flow channels 11 and 13 with the slurry pump 12 and circulated. By circulating the raw slurry when a trouble occurs in particular, it is possible to effectively maintain the flow of the slurry and prevent devices and pipes from clogging.

Porous coal means: so-called low grade coal that contains a large quantity of water and is desired to be dewatered; and for example coal containing water by as much as 30 to 70 weight %. As such porous coal, brown coal, lignite, and sub-bituminous coal are named for example. For example, Victoria coal, North Dakota coal, and Venga coal are named as the brown coal, and West Banko coal, Binunngan coal, Samarangau coal, and eco-coal are named as the sub-bituminous coal. Porous coal is not limited to the above examples, any coal is included in the porous coal according to the present invention as long as the coal contains a large quantity of water and is desired to be dewatered. Generally, the porous coal is used by being pulverized beforehand. The grain size of the porous coal is not particularly limited and, for example, may be about several millimeters, in particular about 0.05 to 3 mm, in average grain size.

A heavy oil content means a heavy content such as vacuum residual oil that substantially does not show vapor pressure even at 400° C. for example or oil containing such a heavy content abundantly. Consequently, if only a heavy oil content is used and is tried to be heated until such a fluidity as to be able to intrude into fine pores of porous coal is obtained, the porous coal itself decomposes thermally. Further, since a heavy oil content used in the present invention scarcely shows vapor pressure as stated above, it is more difficult to vaporize and deposit it by conveying it with a carrier gas. As a result, with only a heavy oil content, not only a good slurry is hardly obtained because of the high viscosity but also the intrusiveness into fine pores lowers because volatility is scarcely exhibited. Consequently, the cooperation of some sort of a solvent or a disperser is required.

In view of the above situation, in the present invention, a heavy oil content is used after it is dissolved in a solvent oil content and the impregnation operability and the slurry formability are improved. As a solvent oil content for dispersing the heavy oil content, a low-boiling point oil is preferably used from the viewpoint of affinity with a heavy oil content, handleability as slurry, and intrusiveness into fine pores. In consideration of the stability at a temperature for vaporizing water, it is recommended to use petroleum-based oil (kerosene, light oil, heavy oil, or the like) having a boiling point of 100° C. or higher and preferably 300° C. or lower. By using such mixed oil containing a heavy oil content as stated above, appropriate fluidity is obtained and hence such intrusion into fine pores as not obtained with a heavy oil content alone is accelerated.

Here, such mixed oil containing a heavy oil content as stated above may be either (1) a substance obtained as mixed oil containing both a heavy oil content and a solvent oil content from the beginning or (2) a substance obtained by mixing a heavy oil content with a solvent oil content. As examples of the former case (1), named are: petroleum-based heavy oil; a petroleum-based light oil fraction, a kerosene fraction, or a lubrication oil component, those being not refined and containing a heavy oil content; coal tar; light oil or kerosene undesirably containing a heavy oil content as an impurity since it has been used as a solvent or a cleaning agent; heat transfer oil undesirably containing a deteriorated fraction because it is used repeatedly; and others. As examples of the latter case (2), named are: petroleum asphalt; natural asphalt; petroleum-based heavy oil; a petroleum-based or coal-based distillation residue; a substance obtained by mixing a substance abundantly containing those with petroleum-based light oil, kerosene, or lubrication oil; a substance obtained by diluting mixed oil of the former case (1)

with petroleum-based light oil, kerosene, or lubrication oil; and others. Here, asphalt itself is less expensive and has a nature of being hardly exfoliated after it once adheres to active spots and hence is used as a particularly appropriate substance.

The heavy oil content in mixed oil is usually in the range of 0.25% to 15% in weight to the total weight of the mixed oil.

The mixing ratio of mixed oil to porous coal is not particularly limited and usually it is appropriate to control the mixing ratio of a heavy oil content to porous coal is in the range of 0.5% to 30% and in particular 0.5% to 5% in weight in terms of anhydrous coal. If the mixing ratio of a heavy oil content is too small, the quantity adsorbed in fine pores is insufficient and the effect in inhibiting spontaneous firing weakens. If the mixing ratio of a heavy oil content is too large, the cost of oil increases and economical efficiency lowers.

The mixing condition is not particularly limited and usually a raw slurry is obtained by mixing at 40° C. to 100° C. in atmospheric pressure.

The raw slurry is circulated in the slurry circulating flow channels 11 and 13, enters the upstream side slurry circulating flow channels 23 and 24 of the evaporator 2 through the raw slurry supplying flow channel 14 branching from the slurry circulating flow channels, and enters the evaporator 2 through them (the evaporation step). On this occasion, the raw slurry is heated to 100° C. to 250° C. for example with the heat exchanger 20 and enters the evaporator 2. By so doing, water in the raw slurry is evaporated. That is, the raw slurry is dewatered by evaporating water contained in porous coal in the raw slurry. At the same time, mixed oil is impregnated into fine pores of the porous coal. In this way, the adhesion and coating of the mixed oil are processed in accordance with the progress of the vaporization of water in the fine pores. Further, even though moisture remains to some extent, negative pressure is generated when the moisture is condensed during cooling, the mixed oil containing a heavy oil content is aspirated into the fine pores, hence the surface portions in the interior of the fine pores are coated one after another with the mixed oil containing the heavy oil content, and eventually almost all region of fine pore openings is completely filled with the mixed oil containing the heavy oil content. Moreover, since the heavy oil content in the mixed oil is likely to be selectively adsorbed into active spots and is hardly separable if it adheres, the heavy oil content is expected to adhere more preferentially than a solvent oil content resultantly. By shielding the surface portions in the interior of the fine pores from outside air in this way, it comes to be possible to avoid spontaneous firing. Further, since a large quantity of water is dewatered and removed and the interior of the fine pores are filled preferentially with the mixed oil containing the heavy oil content, in particular the heavy oil content, the increase of calorie of the whole porous coal is obtained at a low cost.

It is preferable to apply heating with the heat exchanger 20 under a pressurized condition and a preferable pressure is usually 2 to 15 atmospheres.

Heating time cannot be sweepingly stipulated since usually a series of processes are operated continuously, and any heating time is acceptable as long as the dewatering of porous coal and the impregnation of mixed oil into fine pores are attained.

The dewatered slurry from which water has been evaporated is, as shown in FIG. 1, introduced from the lower part of the evaporator 2 to the upper part of the evaporator 2 through the downstream side slurry circulating flow channels 26, 28, and 29 with the slurry pump 27. On this occasion, it is desirable that the dewatered slurry is heated with the heat exchanger 25 and enters the evaporator 2. By so doing, the water in the slurry can be evaporated more effectively.

Steam generated by the above evaporation: is introduced from the evaporator 2 to the heat exchanger 25 through the compressor 50 and then the flow channel 51; is used as the heat source (the heating medium) of the heat exchanger 25; further is introduced to the heat exchanger 5 through the flow channels 52 and 53; and is used as the heat source (the heating medium) of the heat exchanger 5. The steam having passed through the compressor 50 may also be used as the heat source (the heating medium) of the heat exchanger 20.

The dewatered slurry enters the solid-liquid separator 3 through the dewatered slurry supplying flow channel 41 branching from the slurry circulating flow channels 26, 28, and 29 and is separated into a solid and a liquid, and thereby a solid fraction (upgraded porous coal) and a liquid fraction (mixed oil) are obtained (the solid-liquid separation step).

Various methods can be used as the method for the separation and, for example, a centrifugation method, a sedimentation method, a filtration method, a compression method, and another method can be used. Those methods can be used also in combination. The centrifugation method is preferably used from the viewpoint of separation efficiency.

The mixed oil recovered by the solid-liquid separation is returned to the mixing tank 1 as recycle oil through the mixed oil circulating flow channel 45 by the circulation means 4 (the circulation step). On this occasion, the mixed oil is heated with the heat exchanger 5 as stated above (the mixed oil heating step) and thereafter is used again for preparing a raw slurry in the mixing tank 1.

As the circulation means 4, a centrifugal pump is used.

The solid fraction (the upgraded porous coal) separated at the solid-liquid separation step: is usually still wet by the mixed oil; hence enters a dryer; is dried; and comes to be in the state of being usable as a powdered solid fuel (the final drying step).

The drying method is not particularly limited as long as the method can evaporate and separate mixed oil from upgraded porous coal.

The dried upgraded porous coal is cooled and briquetted if desired and a solid fuel is obtained (the cooling step and the briquetting step). For example, the upgraded porous coal can be: cooled at the cooling step and used as a powdered solid fuel; or cooled at the cooling step, thereafter briquetted at the briquetting step, and used as a briquetted solid fuel. Otherwise, a briquetted solid fuel may be obtained by being briquetted at the briquetting step without being cooled.

In the present embodiment, the heat exchangers 20 and 25 are installed in the slurry circulating flow channels and, even when the supply of raw coal (RC) and mixed oil (MO) and the supply of slurry to the subsequent steps are stopped, the flow of the slurry can be maintained and hence the pipes in the heat exchangers are prevented from clogging.

Second Embodiment

Figure 2:
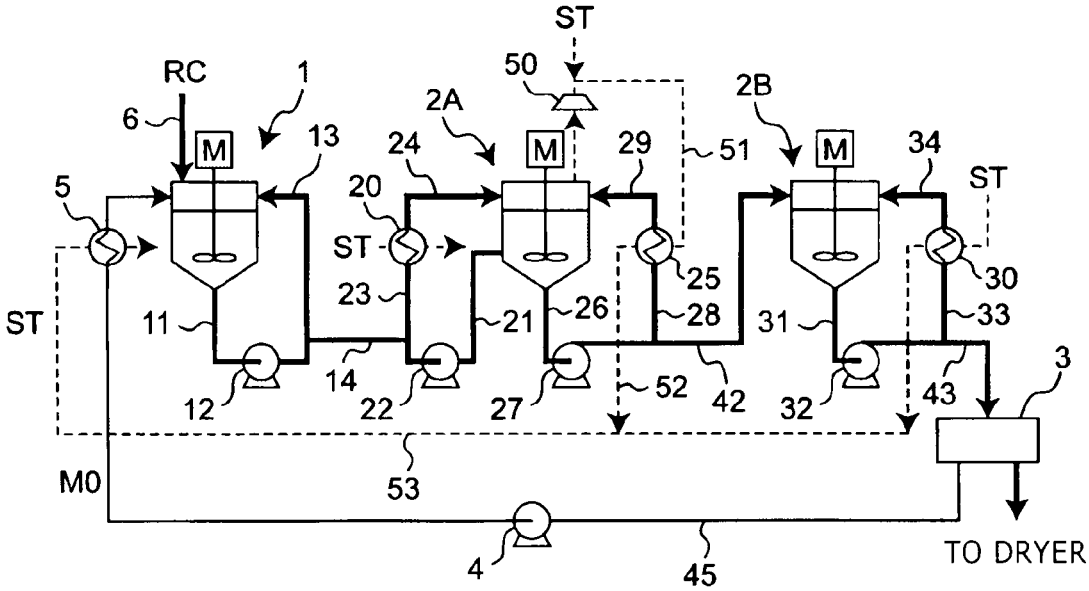
FIG. 2 is a general configuration diagram showing another embodiment of an apparatus for producing a solid fuel according to the present invention.

An apparatus for producing a solid fuel according to a second embodiment of the present invention is shown in FIG. 2.

An apparatus according to the present embodiment comprises:

a mixing tank 1 for obtaining a raw slurry by mixing porous coal with mixed oil containing a heavy oil content and a solvent oil content;

a first evaporator 2A for obtaining a dewatered slurry by heating the raw slurry and thereby processing the evaporation of water;

a second evaporator 2B for obtaining a dewatered slurry by heating and/or depressurizing the dewatered slurry and thereby processing the evaporation of water;

a solid-liquid separator 3 for separating the upgraded porous coal and the mixed oil from each other in the dewatered slurry; and a circulation means 4 for returning the mixed oil having been separated and recovered with the solid-liquid separator to the mixing tank, and is characterized in that the apparatus further has a mixed oil heating heat exchanger 5 for heating the mixed oil returned to the mixing tank by the circulation means. By so doing, the function and the effect similar to those of the first embodiment can be obtained.

An apparatus for producing a solid fuel according to the present embodiment is identical to the apparatus for producing a solid fuel according to the first embodiment except that the first evaporator 2A and the second evaporator 2B are used as the evaporators in the present embodiment. In the present embodiment, a dewatered slurry obtained with the first evaporator 2A is supplied to the second evaporator 2B through a dewatered slurry supplying flow channel 42 and the dewatered slurry obtained with the second evaporator 2B is supplied to the solid-liquid separator 3 through the dewatered slurry supplying flow channel 43. An apparatus according to the present embodiment is hereunder explained briefly but the explanations are identical to those in the first embodiment unless otherwise specified. Here, the instruments and members of the apparatus in the present embodiment represented by the same reference symbols as the first embodiment are the same as those in the first embodiment respectively. The first evaporator 2A in the present embodiment corresponds to the evaporator 2 in the first embodiment.

In the present embodiment, a mixing tank 1 has slurry circulating flow channels 11 and 13 for introducing a raw slurry from the lower part of the mixing tank 1 to the upper part thereof with a slurry pump 12. The evaporator 2A has upstream side slurry circulating flow channels 21, 23, and 24 for introducing slurry from the lower part of the evaporator 2A to the upper part thereof with a slurry pump 22 on the upstream side. The evaporator 2A further has downstream side slurry circulating flow channels 26, 28, and 29 for introducing slurry from the lower part of the evaporator 2A to the upper part thereof with a slurry pump 27 on the downstream side. The evaporator 2B has downstream side slurry circulating flow channels 31, 33, and 34 for introducing slurry from the lower part of the evaporator 2B to the upper part thereof with a slurry pump 32 on the downstream side. A raw slurry supplying flow channel 14 is installed between the mixing tank 1 and the evaporator 2A. The raw slurry supplying flow channel 14 branches from the slurry circulating flow channels 11 and 13. A dewatered slurry supplying flow channel 42 is installed between the evaporator 2A and the evaporator 2B. The dewatered slurry supplying flow channel 42 branches from the slurry circulating flow channels 26, 28 and 29. A dewatered slurry supplying flow channel 43 is installed between the evaporator 2B and the solid-liquid separator 3. The dewatered slurry supplying flow channel 43 branches from the slurry circulating flow channels 31, 33, and 34. A mixed oil circulating flow channel 45 for returning the mixed oil separated with the solid-liquid separator 3 to the mixing tank 1 is installed between the solid-liquid separator 3 and the mixing tank 1.

In the mixing tank 1, a raw slurry is produced by mixing porous coal with mixed oil containing a heavy oil content and a solvent oil content (the mixing step). The mixed oil is heated with the heat exchanger 5 and hence the raw slurry is already preheated appropriately in the mixing tank. The raw slurry is introduced from the lower part of the mixing tank 1 to the upper part of the mixing tank 1 through the slurry circulating flow channels 11 and 13 with the slurry pump 12 and circulated. When a trouble occurs in particular, by circulating the raw slurry, it is possible to effectively maintain the flow of the slurry and prevent devices and pipes from clogging.

The raw slurry is circulated in the slurry circulating flow channels 11 and 13, enters the upstream side slurry circulating flow channels 23 and 24 of the evaporator 2A through the raw slurry supplying flow channel 14 branching from the slurry circulating flow channels, and enters the evaporator 2A through them (the first evaporation step). On this occasion, the raw slurry is heated to 100° C. to 250° C. for example with the heat exchanger 20 and enters the evaporator 2A. By so doing, water in the raw slurry is evaporated (the first stage water evaporation processing) in the same way as the evaporation step in the first embodiment.

The dewatered slurry having been subjected to the first stage water evaporation processing is introduced from the lower part of the evaporator 2A to the upper part of the evaporator 2A through the downstream side slurry circulating flow channels 26, 28, and 29 with the slurry pump 27. On this occasion, it is desirable that the dewatered slurry is heated with the heat exchanger 25 and enters the evaporator 2A. By so doing, the water in the slurry can be evaporated more effectively.

The dewatered slurry having been subjected to the first stage water evaporation processing enters the evaporator 2B through the dewatered slurry supplying flow channel 42 branching from the slurry circulating flow channels 26, 28, and 29 (the second evaporation step). Depressurization is applied in the evaporator 2B. The slurry entering the evaporator 2B is not only depressurized but also introduced from the lower part of the evaporator 2B to the upper part of the evaporator 2B through the slurry circulating flow channels 31, 33, and 34 with the slurry pump 32 and, on this occasion, heated with the heat exchanger 30. The second stage water evaporation processing of the slurry is carried out by the heating and the depressurization. That is, the fine pore water and the crystal water of the water contained in the porous coal in the slurry evaporate, the porous coal is dewatered, and thus the evaporation of water is accomplished more effectively. The impregnation of the mixed oil into the fine pores of the porous coal is also attained in accordance with the dewatering. Here, in parallel with or in place of the heating with the heat exchanger 30 in the slurry circulating flow channels 31, 33, and 34, heating may be applied with a heat exchanger in the slurry circulating flow channel 42. In the second stage water evaporation processing, it is also possible to apply either only heating or only depressurization.

Steam generated by the above first stage water evaporation processing: is introduced from the evaporator 2A to the heat exchanger 25 through the compressor 50 and then the flow channel 51; is used as the heat source (the heating medium) of the heat exchanger 25; further is introduced to the heat exchanger 5 through the flow channels 52 and 53; and is used as the heat source (the heating medium) of the heat exchanger 5. The steam having passed through the compressor 50 may be used also as the heat source (the heating medium) of the heat exchanger 20.

The steam generated by the above second stage water evaporation processing, although it is not shown in the figure, may be introduced from the evaporator 2B to the heat exchanger 30 through a compressor and used as the heat source (the heating medium) of the heat exchanger 30. Thereafter, together with the steam generated by the above first stage water evaporation processing, the steam generated by the above second stage water evaporation processing may be introduced to the heat exchanger 5 and used as the heat source (the heating medium) of the heat exchanger 5.

The dewatered slurry subjected to the above second stage water evaporation processing enters the solid-liquid separator 3 through the dewatered slurry supplying flow channel 43 branching from the slurry circulating flow channels 31, 33, and 34 and is separated into a solid and a liquid, and thereby a solid fraction (upgraded porous coal) and a liquid fraction (mixed oil) are obtained (the solid-liquid separation step). An oil fraction remaining in the solid fraction is recovered with a dryer (a final drying section) and the solid fraction comes to be in the state of being usable as a powdered solid fuel. Otherwise, after the final drying section, the solid fraction is briquetted at a briquetting section and comes to be a briquetted solid fuel.

The mixed oil recovered by the solid-liquid separation is returned to the mixing tank 1 through the mixed oil circulating flow channel 45 as recycle oil by the circulation means 4 (the circulation step). On this occasion, the mixed oil is heated with the heat exchanger 5 (the mixed oil heating step) and thereafter is used again for preparing a raw slurry in the mixing tank 1.

In the present embodiment, the heat exchangers 20, 25, and 30 are installed in the slurry circulating flow channels, thus the flow of slurry can be maintained even when the supply of raw coal (RC) and mixed oil (MO) and the supply of slurry to the subsequent steps are stopped, and hence the clogging of pipes in the heat exchangers can be prevented.

EXAMPLES

Example 1

Figure 3:
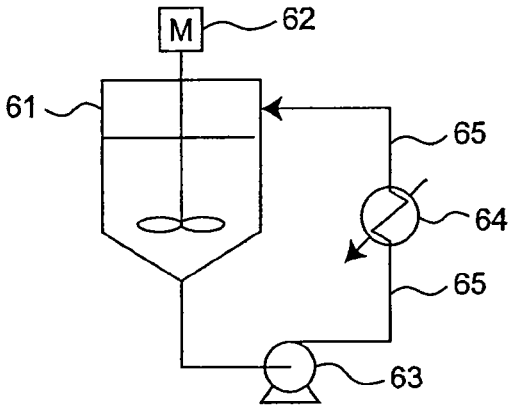
FIG. 3 is a schematic view of a slurry dewatering test apparatus used in an example.
Figure 4:
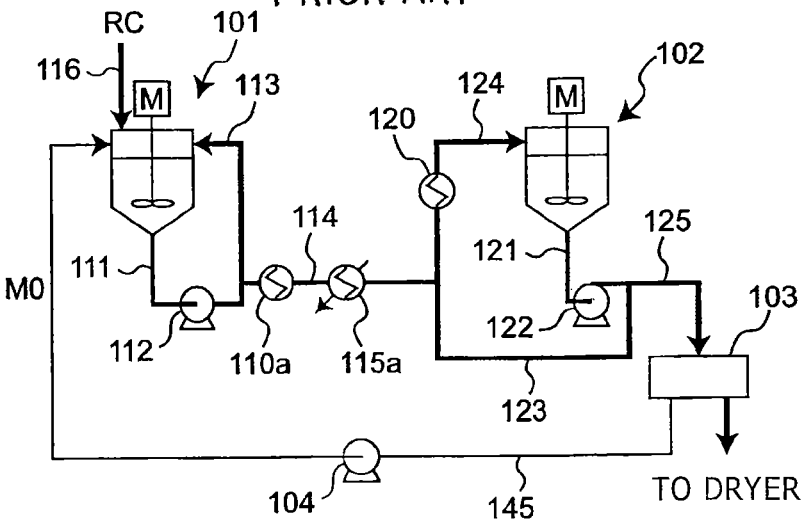
FIG. 4 PRIOR ART
FIG. 4 is a general configuration diagram showing an apparatus for producing a solid fuel according to a conventional technology.
Figure 5:
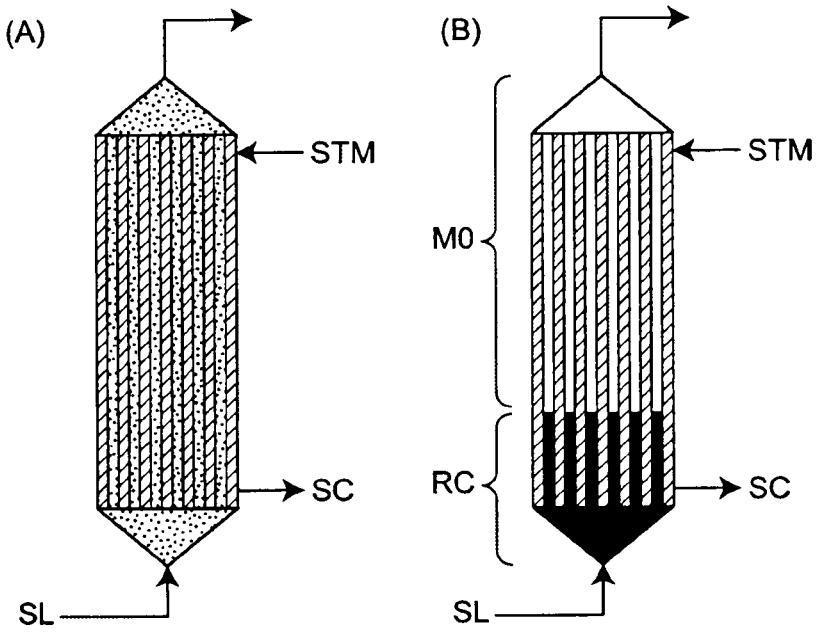
FIG. 5(A) is a view showing a state where slurry is smoothly heat-treated with a heat exchanger and FIG. 5(B) is a view showing a state where slurry sediments and deposits in a heat exchanger.
Figure 6:
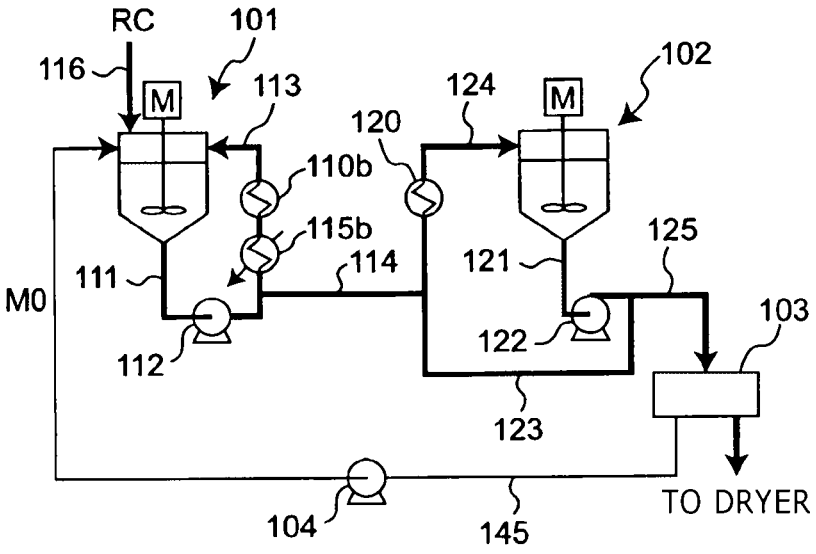
FIG. 6 is a general configuration diagram showing an apparatus for producing a solid fuel according to a conventional technology.

Dewatering test is carried out by the following method with a slurry dewatering test apparatus shown in FIG. 3. As raw materials, 150 kg of eco-coal pulverized into a grain size of 3 mm or less, 200 kg of kerosene, and 0.5 kg of asphalt are put into a dewaterer 61, stirred with a stirrer 62 in the dewaterer, and, in the state of slurry, fed into a heat exchanger 64 and a pipe 65 with a slurry pump 63. More specifically, a pressure of 0.4 MPaG is applied by nitrogen with the slurry pump 63 and thereafter the slurry is heated by feeding steam to the heat exchanger 64. Thereafter, the slurry pump 63 is stopped, the slurry is left for 5 minutes, and the slurry pump 63 is activated again. The result is that the circulation of the slurry cannot be restarted. The interior of the heat exchanger 64 is checked and as a result it is found that all the pipes clog as shown in FIG. 5(B) and the pipes are firmly packed with pulverized coal. The material stuffed in the pipes can be removed only by jet washing with water.

In this way, when the flow of slurry in a heat exchanger stops, pulverized coal sediments and piles up firmly. In the operation of an apparatus for producing a solid fuel, the flow of slurry in a heat exchanger has to be maintained always even when the supply of raw materials is stopped because of troubles.

Example 2

Test for producing a solid fuel is carried out by using a test apparatus having the same configuration as FIG. 1.

200 kg of kerosene and 0.5 kg of asphalt are put into a mixing tank 1 and a production test apparatus is operated. When the operation becomes steady state, the feed rate of mixed oil is 300 kg/hr, the feed rate of raw coal is 200 kg/hr, the flow rate of slurry in a slurry circulating flow channel 13 is 250 kg/hr, the flow rate of slurry in a raw slurry supplying flow channel 14 is 500 kg/hr, and the slurry temperature in the mixing tank 1 is 75° C.

Thereafter, the supply of the raw coal and the mixed oil and the supply of the raw slurry to an evaporation step are stopped and the operation of a slurry pump 12 is continued. After the lapse of 5 minutes, no condensation is recognized at all in a raw coal supplying means 6 and, when the production of a solid fuel is restarted, raw coal can be smoothly supplied from the raw coal supplying means 6.

Comparative Example 1

Test for producing a solid fuel is carried out by using a test apparatus having the same configuration as FIG. 1 except that a heat exchanger 5 is attached to a slurry circulating flow channel 13 for heating slurry instead of being attached to a mixed oil circulating flow channel 45 for heating mixed oil.

200 kg of kerosene and 0.5 kg of asphalt are put into a mixing tank 1 and the production test apparatus is operated. When the operation becomes steady state, the feed rate of mixed oil is 300 kg/hr, the feed rate of raw coal is 200 kg/hr, the flow rate of slurry in a slurry circulating flow channel 13 is 250 kg/hr, the flow rate of slurry in a raw slurry supplying flow channel 14 is 500 kg/hr, and the slurry temperature in the mixing tank 1 is 75° C.

Thereafter, the supply of the raw coal and the mixed oil, the supply of the raw slurry to an evaporation step, and the supply of steam to the heat exchanger 5 are stopped and the operation of a slurry pump 12 is continued. After the lapse of 5 minutes, condensation is recognized in a raw coal supplying means 6 and, when the production of a solid fuel is restarted, clogging of the raw coal supplying means 6 is caused by the raw coal.

INDUSTRIAL APPLICABILITY

An apparatus and a process for producing a solid fuel according to the present invention are useful for producing a solid fuel by using porous coal (coal), in particular low grade coal, as a material.

The invention claimed is:

1. An apparatus for producing a solid fuel, comprising:

a mixing tank for obtaining a raw slurry by mixing porous coal with mixed oil containing a heavy oil content and a solvent oil content;

an evaporator for obtaining a dewatered slurry by heating the raw slurry to evaporate water;

a solid-liquid separator for separating upgraded porous coal and the mixed oil from each other in the dewatered slurry;

a circulation element for returning the mixed oil, having been separated and recovered by the solid-liquid separator, to the mixing tank; and a mixed oil heating heat exchanger for heating the mixed oil being returned to the mixing tank by the circulation element, wherein the circulation element for returning the mixed oil is a circulating flow channel connected between the solid-liquid separator and the mixing tank, and wherein the mixed oil heating heat exchanger is provided at a location along the circulating flow channel.

2. The apparatus according to claim 1, wherein steam generated in the evaporator is employed as a heat source for the mixed oil heating heat exchanger.

3. An apparatus according to claim 1, wherein the evaporator comprises:

a first evaporator for obtaining a dewatered slurry by heating the raw slurry to evaporate water; and a second evaporator for obtaining a dewatered slurry by heating and/or depressurizing the dewatered slurry to evaporate water.

4. A process for producing a solid fuel, comprising:

mixing porous coal with mixed oil containing a heavy oil content and a solvent oil content in a mixing tank, to obtain a raw slurry;

heating the raw slurry in an evaporator to evaporate water from the raw slurry to obtain a dewatered slurry;

separating, in a separator, upgraded porous coal and the mixed oil from each other in the dewatered slurry;

returning the mixed oil, having been separated and recovered in the separating step, to the mixing tank via a circulating flow channel connected between the separator and the mixing tank; and heating the mixed oil to be returned to the mixing tank, during the returning step using a heat exchanger provided in the circulating flow channel.

5. An apparatus according to claim 2, wherein the evaporator comprises:

a first evaporator for obtaining a dewatered slurry by heating the raw slurry to evaporate water; and a second evaporator for obtaining a dewatered slurry by heating and/or depressurizing the dewatered slurry to evaporate water.

6. The apparatus according to claim 1, wherein the evaporator is connected to the mixing tank by a line carrying the raw slurry for providing the raw slurry to the evaporator, wherein the line carrying the raw slurry lacks a heat exchanger, whereby the raw slurry from the mixing tank is not heated by a heat exchanger before reaching the evaporator.

7. The process according to claim 4, wherein the evaporator is connected to the mixing tank by a line carrying the raw slurry for providing the raw slurry to the evaporator, wherein the line carrying the raw slurry lacks a heat exchanger, and wherein the raw slurry from the mixing tank is not heated by a heat exchanger before reaching the evaporator.

* * * * *